US005887791A

United States Patent [19]

Rothe

[11] Patent Number: 5,887,791

[45] Date of Patent: Mar. 30, 1999

[54] NUCLEATOR ASSEMBLY FOR SNOWMAKING APPARATUS

[75] Inventor: Charles E. Rothe, Saugerties, N.Y.

[73] Assignee: Saugerties Snow Equipment Inc., Saugerties, N.Y.

[21] Appl. No.: 801,149

[22] Filed: Feb. 18, 1997

[51] Int. Cl.[6] ..... F25C 3/04

[52] U.S. Cl. ..... 239/14.2; 261/78.2

[58] Field of Search ..... 239/2.2, 14.2; 261/78.2

[56] References Cited

U.S. PATENT DOCUMENTS 4,105,161 8/1978 Kircher et al. ..... 239/14.2

4,493,457 1/1985 Dilworth et al. ..... 239/14.2 X 5,180,106 1/1993 Handield ..... 239/14.2

5,379,937 1/1995 Rothe ..... 239/14.2

5,400,966 3/1995 Weaver et al. ..... 239/2.2

5,518,177 5/1996 Weaver et al. ..... 239/14.2 X

*Primary Examiner*—Lesley D. Morris

*Attorney, Agent, or Firm*—Charles J. Brown

[57] ABSTRACT

In snowmaking apparatus having a fan which forces air through a tubular housing, an improved nucleator assembly wherein an air-water mixture is injected at an angle into the airstream close to the downstream side of the fan and remote from the housing outlet from nozzles on vanes designed to create turbulence and wherein the air-water mixture for the nucleator is formed in a multi-passage mixing block on the exterior of the housing with the pressure of both the air and water regulated.

11 Claims, 6 Drawing Sheets

NUCLEATOR ASSEMBLY FOR SNOWMAKING APPARATUS

BACKGROUND OF THE INVENTION

In my U.S. Pat. No. 5,379,937 there is described a nucleating assembly for snowmaking apparatus which is the prior art design upon which the improvements of the invention have been made. The nucleating nozzles in that design are positioned far downstream from the fan and its flow straightening fins almost at the outlet end of the housing where water is sprayed into the airstream. The mixing of air and water for the nucleators takes place within the nucleator vanes themselves in that prior art design immediately upstream of the nucleating nozzles. The downstream edge portions of those nucleator vanes are tapered in the same manner as their upstream edge portions.

In addition the mixture of air and water ejected from the nucleator nozzles enters the airstream in a direction parallel to the axis of the tubular housing rather than at an angle thereto. Ejection of an air-water mixture from a nucleator nozzle in snowmaking apparatus at an angle to the tubular housing axis is not itself novel as shown by U.S. Pat. Nos. 4,105,161 and 5,180,106. However the air-water mixture in those prior art patents is not ejected directly into the straight airstream flow but rather into the lee or shadow of other parts in the tubular housing around which the airstream flows. In U.S. Pat. No. 5,180,106 that other part is a manifold casing around the nucleator nozzles and in U.S. Pat. No. 4,105,161 it is a deflector which directs the airstream flow away from the nucleator nozzles.

It is the principal purpose of the present invention to improve the nucleating effect of the nucleator assembly by changing the position of the nucleator nozzles in relation to the downstream air spray, by mixing the water and air well upstream from the nucleating nozzles, by designing the nucleator vanes so that they create turbulence around the nucleator nozzles, and by angling the air-water mix into the straight line airstream flow.

SUMMARY OF THE INVENTION

The invention provides a nucleator assembly for snowmaking apparatus wherein an extended tubular housing has opposite coaxial inlet and outlet ends with a fan mounted concentrically with respect to the housing remote from the housing outlet end. The fan forces an airstream through the housing. Flow straightening fins are included in the housing remote from the housing outlet end downstream of and adjacent to the fan. Water spray means are included downstream from the fins adjacent the housing outlet end for spraying water into the airstream.

The nucleator assembly of the invention comprises at least one vane extending into the airstream at a location closer to the flow straightening fins than to the water spray means. The vane has flat sides disposed parallel to the airstream flow and upstream and downstream edge portions substantially narrower than the flat sides. On the downstream edge portion of the vane a nozzle is spaced radially from the housing axis and located directly in straight airstream flow from the fan. A mixing block defining a mixing chamber is provided wherein pressurized air and water are mixed and then delivered to the nozzle for ejection into the airstream.

In a preferred form of the invention the nozzle on the vane is disposed at an angle to the tubular housing axis to eject the air and water mixture at an angle into the straight airstream flow. The upstream edge portion of the vane may be tapered to present minimal resistance to the airstream flow and the downstream edge portion may be flat to cause turbulence in the airstream flow into which the air and water mixture is ejected from the nozzle. A plurality of vanes may be included spaced angularly apart and disposed radially with respect to the housing axis. In a preferred form of the invention the vanes are two in number and are spaced apart on opposite sides of the housing axis. The vanes may be mounted on the inside surface of the tubular housing and cantilevered radially inwardly toward the housing axis.

The mixing block may be exterior to the tubular housing and conduit means may be included for directing the mixture of air and water through the vane and out its nozzle. Respective pressure regulators may be included for regulating the pressure of the water and air entering the mixing chamber.

Separate fluids may enter the mixing chamber of the mixing block each through its own inlet port, with the mixture exiting from at least one outlet port. Straight holes may converge into the block from the respective ports each with an inner end substantially of concave shape. The concave inner end of each hole intersects with the concave inner ends of at least two of the other holes to form cross openings among the hole inner ends. As a result, when fluids are introduced through the inlet ports they pass through the openings to be mixed together and are then discharged from the outlet port.

In a preferred form of the mixing block of the invention two fluids enter the block through two respective inlet ports and after mixing are discharged through two respective outlet ports with two cross openings in the concave inner end of each hole. The holes are preferably of equal diameter and each hole may be at right angles to two other holes. The cross openings are preferably all of substantially equal cross sectional area.

DESCRIPTION OF PREFERRED EMBODIMENT

Figure 1:
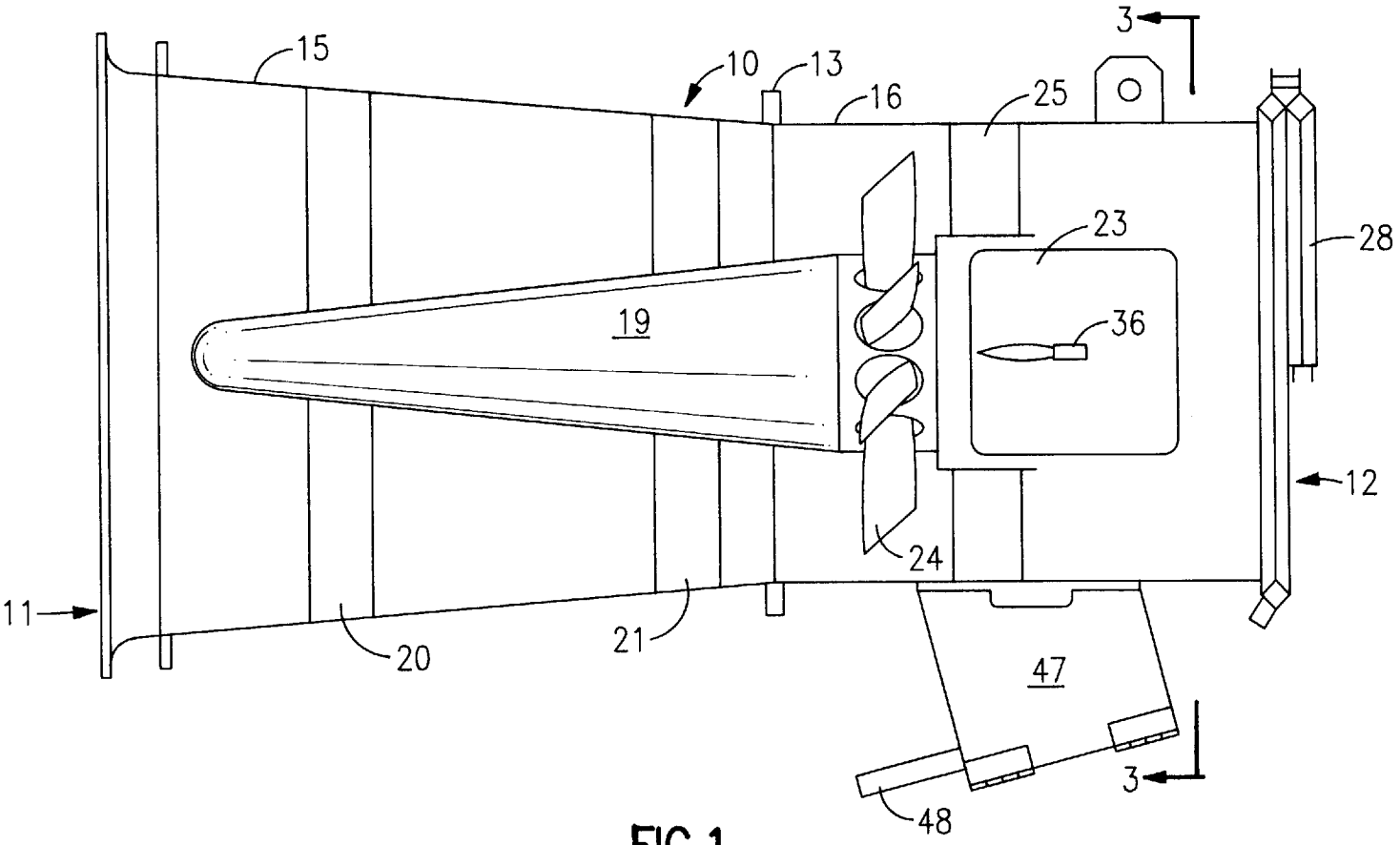
FIG. 1 is a longitudinal elevation of snowmaking apparatus equipped with the nucleator assembly of the invention with the tubular housing in half section to show the internal components of the apparatus.
Figure 2:
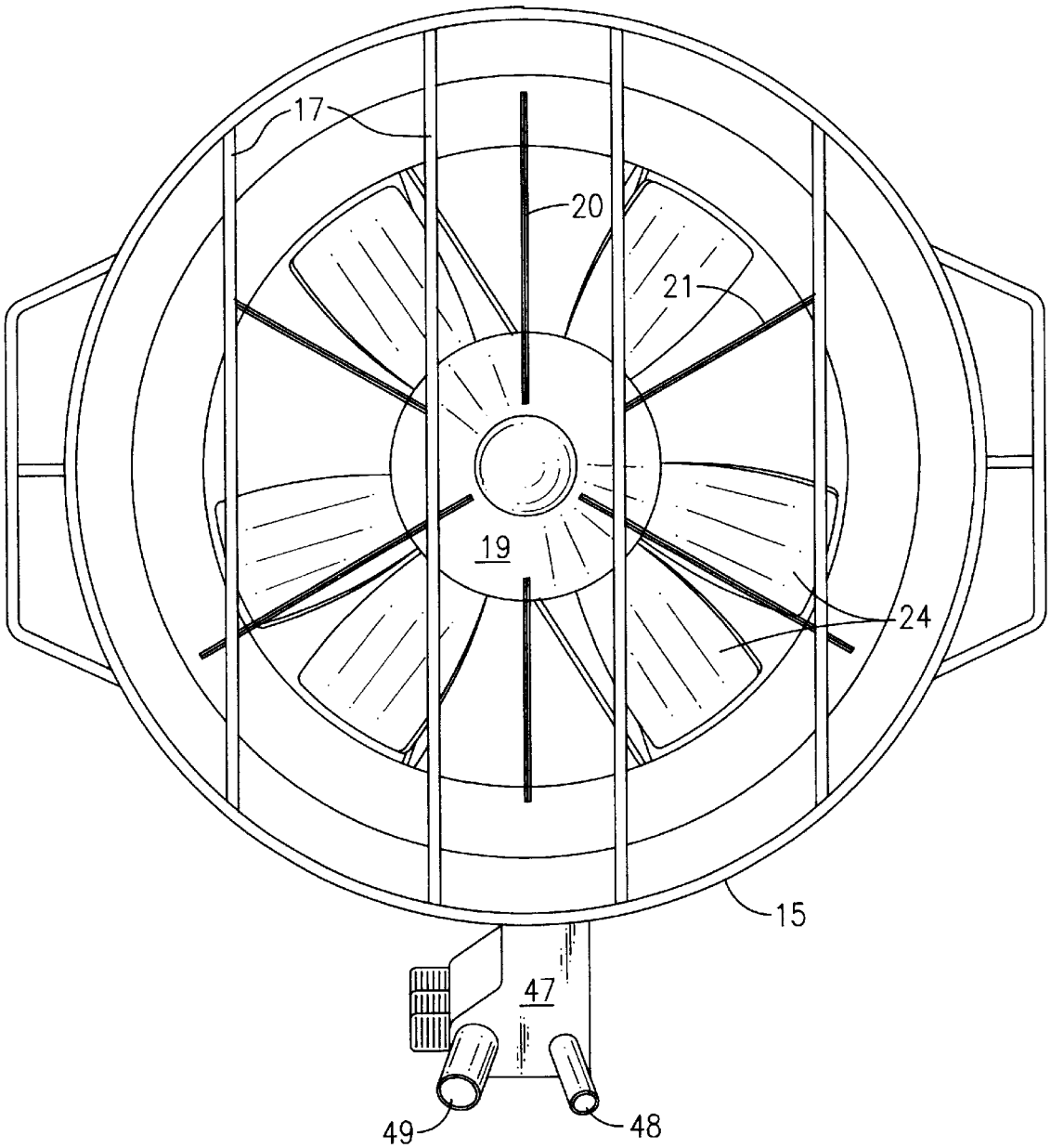
FIG. 2 is an end view of the inlet end of the tubular housing of FIG. 1.
Figure 3:
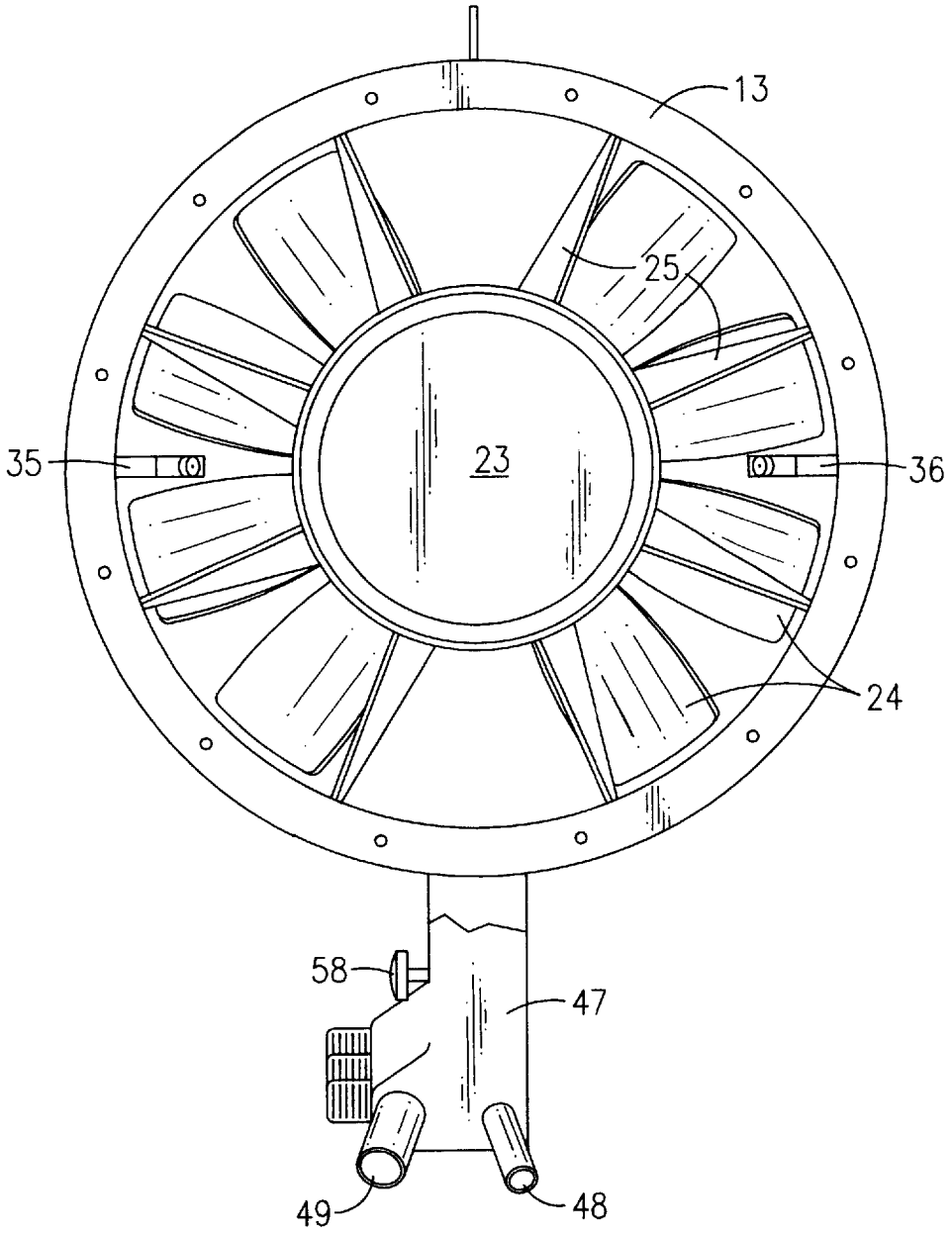
FIG. 3 is a section taken along the line 3—3 of FIG. 1.

Referring first to FIGS. 1 to 3 the snowmaking apparatus of the invention includes an extended tubular housing 10 having an inlet end 11 and an outlet end 12. The housing 10 may be formed in two sections joined at flanges 13. An upstream converging section 15 and a downstream cylindrical section 16 are provided. As shown in FIG. 2 a grating 17 extends across the inlet end 11 of the housing to prevent entry of foreign objects.

Mounted coaxially within the housing is a fixed conical inlet diffuser 19 supported by appropriate radial ribs 20 and 21. Held by suitable radial supports (not shown) is a coaxial electric motor 23 which drives a fan 24 adapted to force a stream of sub-freezing ambient air through the tubular housing 10 from the inlet end to the outlet end 12. It is known in the design of fan-type snowmaking apparatus to remove some blades of the fan 24, as appears in FIG. 2, to render it asymmetrical and then balance the fan by appropriate weights applied elsewhere to rotating parts, all for the purpose of reducing noise emitted during operation. Conventional flow straightening fins 25 are provided as shown particularly in FIGS. 1 and 3 immediately downstream of the fan 24.

At the outlet end 12 of the housing 10 are spray means for spraying water into the cold airstream forced through the housing 10. This may comprise circular headers 28 with appropriate nozzles (not shown) spaced equally angularly apart around the headers.

In accordance with the invention an improved nucleator assembly is provided for introducing a dispersion of air-water mixture into the cold airstream to provide nuclei for the formation of ice crystals when mixed with the water sprayed from the headers 28. Principal components of this nucleator assembly are a pair of radially disposed vanes 35 and 36 shown in FIGS. 1 and 3 to 6, each with a nozzle 39 from which an air-water mixture is ejected. Each of the vanes 35 and 36 is bolted to the inside surface of the tubular housing 10 by bolt holes 37 and 38 visible in FIGS. 4 and 5. The vanes are cantilevered radially inwardly toward the housing axis as shown particularly in FIG. 3.

Among the features of the vanes 35 and 36 of importance in this invention is their placement as shown in FIG. 1 quite close to the fan 24 and quite remote from the outlet end of the housing 10. Specifically the vanes are located much closer to the flow straightening fins 25 than to the headers 28 of the water spray means. This is in contrast to the placement of the vanes in my prior U.S. Pat. No. 5,379,937 well downstream not only of the fan and flow straightening fins but of the motor as well and quite close to the outlet end of the tubular housing. By positioning the vanes 35 and 36 further upstream close to the fins 24 the air-water mixture ejected from their nozzles 39 must travel a substantially greater distance before mixing with the water sprayed from the headers 28 at the outlet end 12 of the housing. As a consequence of this increased travel distance the dispersion of the air-water mixture is measurably increased and its nucleating effect in forming artificial snow is significantly improved.

Another feature of the vanes 35 and 36 of importance in this invention is that the air-water nozzles 39 are disposed at a 45° angle to the axis of the tubular housing 10 so that they eject the air water mixture at that angle into the straight airstream flow. This has been found to further increase the dispersion of the air-water mixture and hence improve its nucleating effect in forming artificial snow.

Yet another feature of the vanes 35 and 36 in this invention is that their upstream and downstream edge portions are of an optimum design. As in my prior patent the upstream edge portion 40 is tapered to present minimal resistance to the airstream flow. However in this invention the downstream edge portion 41 is not tapered but is flat to cause turbulence into the airstream flow into which the air and water mixture is ejected from the nozzle. This turbulence also enhances dispersion of the air-water mixture and further improves the nucleating effect in forming artificial snow. (It is to be noted that the motor 23 does not have a downstream conical diffuser as in my prior U.S. Pat. No. 5,379,937 so that its somewhat squared off downstream end causes still more turbulence to further enhance nucleation).

Figure 4:
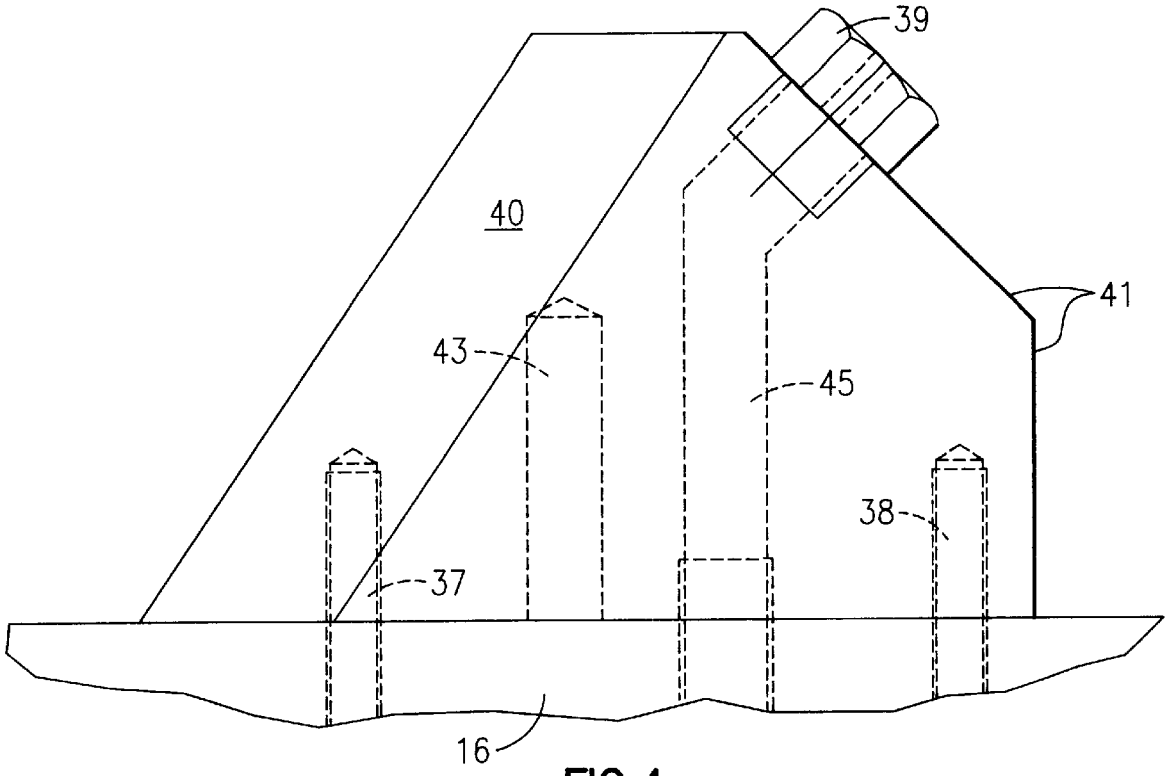
FIG. 4 is a side elevation of one of the vanes of the invention with its angled nozzle.
Figure 5:
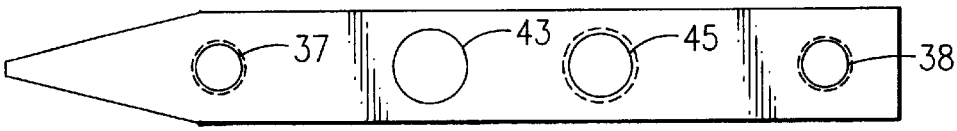
FIG. 5 is an end view of that surface of the vane of FIG. 4 joined to the inside surface of the tubular housing.
Figure 6:
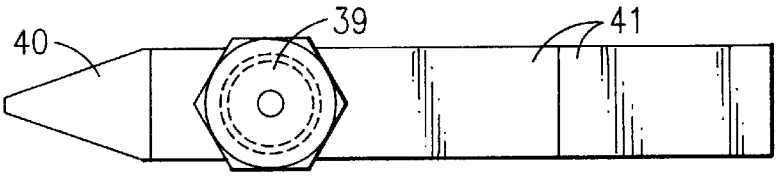
FIG. 6 is an end view of the vane of FIG. 4 looking directly into the nozzle.

Each of the vanes 35 and 36 includes a socket 43 visible in FIGS. 4 and 5 for receiving a removable electric cartridge of a commercially available type to warm the vane and prevent formation of rime ice.

Each of the vanes 35 and 36 is formed with an internal passage 45 leading to its nozzle 39 from and communicating through a hole in the housing 10 with air-water mixing apparatus 47 mounted on the underside of the section 16 of the housing 10 as shown in FIG. 1. Pressurized air and water source lines 48 and 49 are connected in the apparatus 47 to respective air and water supply hoses 50 and 51. The air from the air hose 50 passes through an air pressure regulator 52 to deliver the air at a predetermined level of pressure. Similarly the water hose 51 delivers water through a water pressure regulator 53 at a certain level of pressure slightly below the predetermined air pressure.

Figure 8:
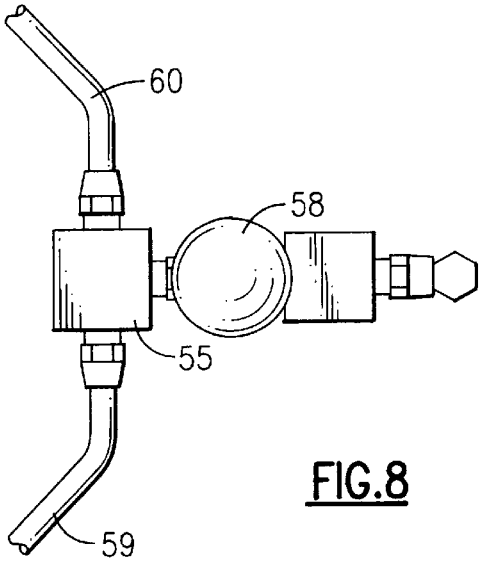
FIG. 8 is a fragmentary plan view of the air and water mixing components of certain of the nucleator apparatus shown in FIG. 7.
Figure 7:
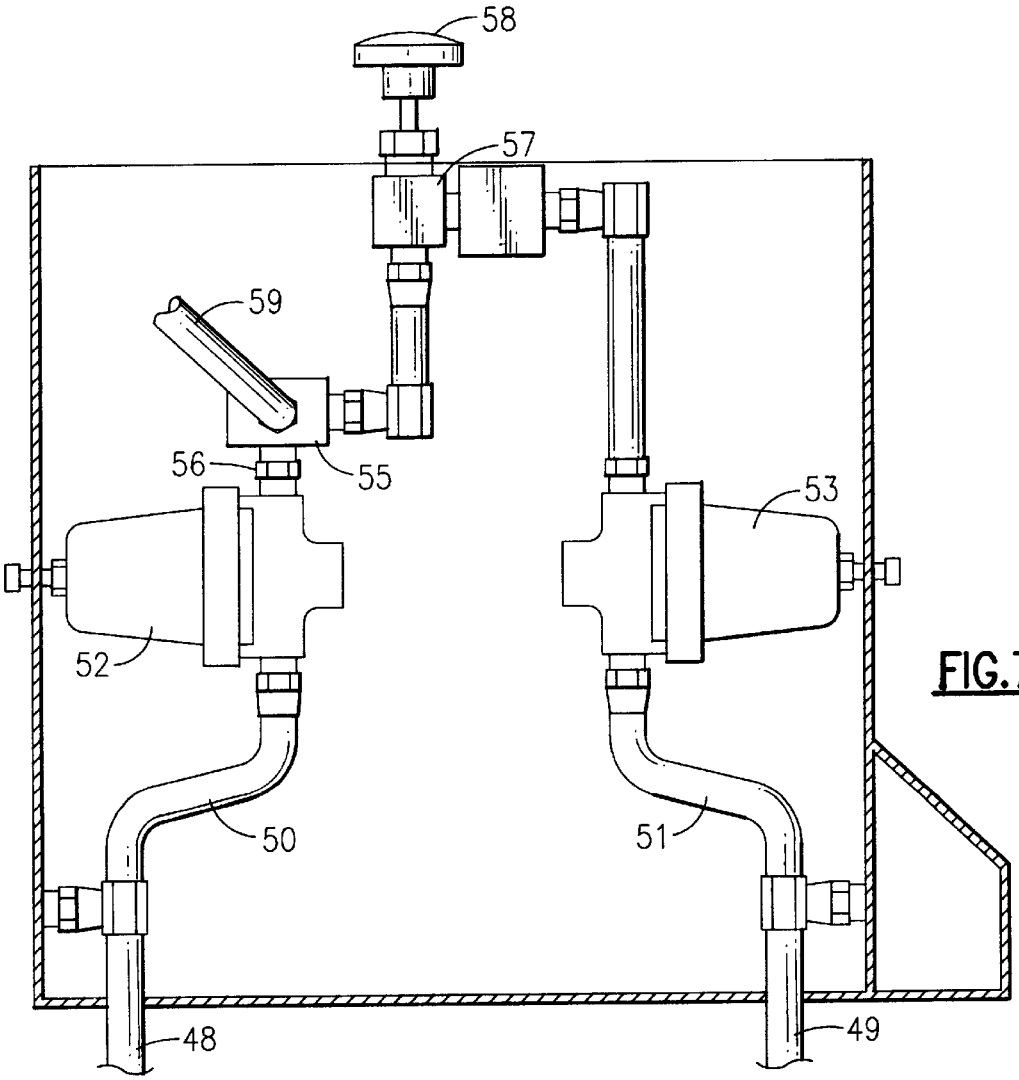
FIG. 7 is an elevation in section of the air-water mixing components of the apparatus.

The air from the regulator 52 and the water from the regulator 53 come together in a mixing block 55 described in detail below. The air passes through a check valve 56 between the air pressure regulator 52 and the mixing block 55. The water passes through a flow control valve 57 operated by a control knob 58 between the water pressure regulator 53 and the mixing block 55. As shown in FIG. 8 a mixture of air and water leaves the mixing block 55 through the hose 59 to the nozzle 39 in the vane 35 and through the hose 60 to the nozzle 39 in the vane 36.

Figure 11:
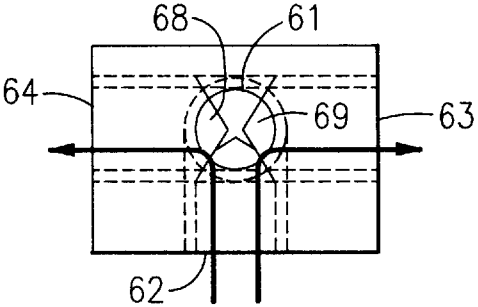
FIG. 11 is a side view of the block looking into the air inlet hole.
Figure 12:
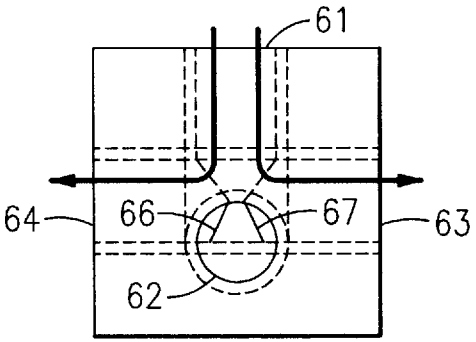
FIG. 12 is a side view of the block looking into the water inlet hole.

Turning now to FIGS. 9 to 13 the multi-passage mixing block 55 is shown in detail. It consists of a metal block into which four holes of equal diameter are drilled at right angles to one another to receive hose connections as follows: A hole 61 shown on end in FIG. 11 communicates with the inlet air hose 50. A hole 62 shown on end in FIG. 12 is connected to the inlet water hose 51. A hole 63 shown on end in FIG. 13 delivers mixed air and water through the hose 59 to the nozzle 39 on the vane 35. A hole 64 shown on end in FIG. 14 delivers air and water mixture through the hose 60 to the nozzle 39 on the vane 36.

Figure 13:
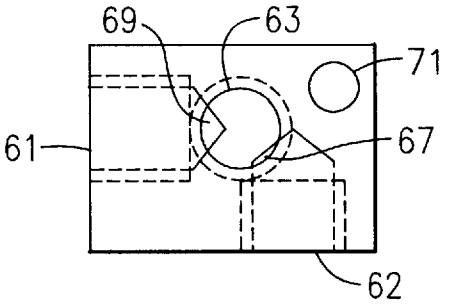
FIG. 13 is a side view of the block looking into one of the air-water outlet holes.
Figure 10:
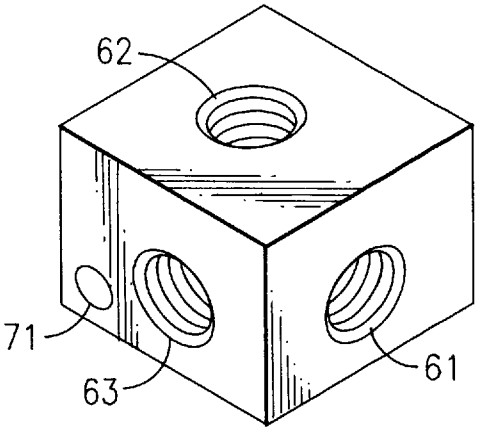
FIG. 10 is a perspective view of the block showing three of the four holes.
Figure 14:
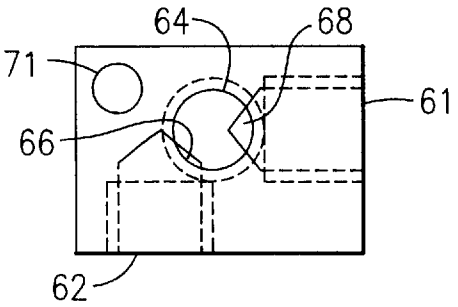
FIG. 14 is a side view of the block looking into the other of the air-water outlet holes.
Figure 9:
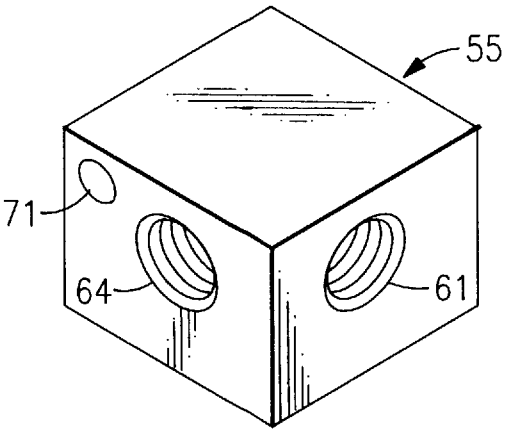
FIG. 9 is a perspective view of the mixing block of the invention showing two of its four holes.

Each of the holes 61 to 64 is drilled with a bit having a conical nose which forms a concave hole inner end. As used herein the term "concave" means an inward surface defined by a true cone or by a section of a sphere or other curved surface. Each hole is drilled to a depth whereby intersection is made between its concave inner end and the concave inner ends of two of the other holes to form cross openings among the hole ends. Thus as shown in FIG. 12 the water inlet hole 62 is drilled to a depth where it forms a cross opening 66 with the mixture outlet hole 64 and a cross opening 67 with a mixture outlet hole 63. As shown in FIG. 11 the inlet air hole 61 is drilled to a point of depth where it forms a cross opening 68 with the mixture outlet hole 64 and a cross opening 69 with the mixture outlet hole 63. As shown in FIG. 14 the mixture outlet hole 64 is drilled to a depth where it forms the cross opening 66 with the water inlet hole 62 and the cross opening 68 with the air inlet hole 61. As shown in FIG. 13 the mixture outlet hole 63 is drilled to a depth where it forms the cross opening 69 with the air inlet hole 61 and the cross opening 67 with the water inlet hole 62. These interconnecting cross openings 66 to 69 together form a mixing chamber for the air and water.

As shown in FIGS. 13 and 14 the axis of the water inlet hole 62 is offset from the axis of the mixture outlet hole 64. The purpose of this is to space the cross opening 66 well away from the cross opening 68 so that the metal between the cross openings 66 and 68 is not too thin and thus subject to accelerated wear. As shown in FIG. 13 the axis of the water inlet hole 62 is similarly offset from the access of the mixture outlet hole 63 to space apart the cross openings 67 and 69 for the same reason. To insure that the flow rate of the air-water mixture is substantially the same proceeding to the two nucleator nozzles in the vanes 35 and 36 it is important that the depth of the four holes 61 to 64 be carefully controlled so that the cross openings are of substantially equal area.

A socket 71 is provided in the block 55 for receiving a removable electric cartridge of a commercially available type to warm the block and prevent freezing within it, in a manner similar to the cartridge in the socket 43 in the vanes 35 and 36.

The path of the inlet air through the air inlet hole 61 is shown by the two solid arrow lines in FIG. 12 and the path of the inlet water through the water inlet hole 62 is shown by the two solid arrow lines in FIG. 11. This convergence of air and water through the several cross openings in the concave inner ends of the respective holes and its subsequent separation into two air-water outlet streams is one of the design features of the present invention which enhances its nucleating effect.

In the operation of the nucleator system of the invention the air pressure regulator 52 is pre-set to deliver air at a predetermined pressure (for example 80 psi) at a predetermined flow rate (for example 12 to 20 cfm) to the mixing block 55. Water at a certain flow rate (for example 2 to 3 gpm) is delivered from the water regulator 53 to the valve 57. The control knob 58 is then turned to open the valve 57 to full capacity. The snowmaking apparatus is then started up with the fan 24 creating the airstream through the tubular housing 10 and with water sprayed into that airstream from the headers 28 at the outlet end 12 of the housing 10. The water pressure regulator 53 is then slowly adjusted to increase the flow of water into the mixing block 55. The nuclei of water mixed with air ejected from the nozzles 39 of the nucleator and the resulting artificial snow cast from the outlet end 12 of the tubular housing 10 are both observed until a certain desirable nominal artificial snow condition is achieved, neither markedly lean or dry nor markedly rich or wet. At that point when the nominal condition is achieved the setting of the water pressure regulator 53 is locked up. After installation in the field that nominal snow condition can be varied somewhat by operation of the knob 58. The artificial snow can be made leaner or drier by slightly closing the water valve 57 by means of the knob 58 and it can be made richer and wetter by slightly opening the water valve 57 by means of the knob 58.

As noted previously the efficiency of nucleation is improved in accordance with this invention in several ways. The placement of the nucleator nozzles 39 well upstream from the water spray at the outlet end of the housing 10 causes the mix of water and air from the nucleators to travel further before encountering the spray of water, and this increase in travel time enhances the air-water dispersion and its nucleating effect. The placement of the mixing block 55 well away from the nucleator nozzles 39 results in a greater distance of travel of the air-water mix before emerging from the nozzles 39 and that also improves nucleation. Angling the direction of air-water mixture into the direct straight airstream also improves nucleation. Finally, the squaring off of the downstream edge portion 41 of the nucleator vanes 35 and 36 to increase the turbulence of the airstream around the nozzles further aids the dispersion of the air-water mixture as it is ejected from the nozzles.

This enhancement of nucleation permits a 5 hp air compressor delivering pressurized air to the mixing block 55 to produce just as much or even more superior artificial snow than do compressors of conventional snowmaking apparatus ranging from approximately 7.5 hp to as much as the equivalent of 12 hp.

The scope of the present invention is to be determined by the following claims rather than the foregoing description of a preferred embodiment.

I claim:

1. In snowmaking apparatus wherein an extended tubular housing has opposite coaxial inlet and outlet ends with a fan mounted with respect to the housing remote from the housing outlet end for forcing an airstream through the housing and with flow straightening fins in the housing also remote from the housing outlet end and downstream of and adjacent to the fan with water spray means downstream from the fins adjacent the housing outlet end for spraying water into the airstream, a nucleator assembly comprising a) at least one vane extending into the airstream at a position closer to the flow straightening fins than to the water spray means, b) the vane having flat sides disposed parallel to the airstream flow and upstream and downstream edge portions substantially narrower than said flat sides, c) a nozzle on the downstream edge portion of the vane spaced radially from the housing axis and located directly in straight airstream flow from the fan, d) a mixing block exterior to said tubular housing defining a mixing chamber wherein pressurized air and water are mixed and then delivered to the nozzle for ejection into the air stream, and e) conduit means for directing the mixture of air and water through the vane and out of said nozzle.

2. In snowmaking apparatus wherein an extended tubular housing has opposite coaxial inlet and outlet ends with a fan mounted with respect to the housing remote from the housing outlet end for forcing an airstream through the housing and with flow straightening fins in the housing also remote from the housing outlet end and downstream of and adjacent to the fan with water spray means downstream from the fins adjacent the housing outlet end for spraying water into the airstream, a nucleator assembly comprising a) at least one vane extending into the airstream at a position closer to the flow straightening fins than to the water spray means, b) the vane having flat sides disposed parallel to the airstream flow and upstream and downstream edge portions substantially narrower than said flat sides, c) a nozzle on the downstream edge portion of the vane spaced radially from the housing axis and located directly in straight airstream flow from the fan, d) a mixing block defining a mixing chamber wherein pressurized air and water are mixed and then delivered to the nozzle for ejection into the air stream, and e) respective pressure regulators for regulating the pressure of the water and air entering said mixing block.

3. In snowmaking apparatus wherein an extended tubular housing has opposite coaxial inlet and outlet ends with a fan mounted axially within the housing remote from the housing outlet end for forcing an airstream through the housing and with flow straightening fins in the housing also remote from the housing outlet end and downstream of and adjacent to the fan with water spray means downstream from the fins adjacent the housing outlet end for spraying water into the airstream, a nucleator assembly comprising a) two vanes mounted apart on opposite sides of the inside surface of the tubular housing each cantilevered radially inwardly into the airstream toward the housing axis at a position closer to the flow straightening fins than to the water spraying means, b) each vane having flat sides disposed parallel to the airstream flow and upstream and downstream edge portions substantially narrower than said flat sides with the upstream edge portion tapered to present minimal resistance to the airstream flow and the downstream edge portion flat to cause turbulence in the airstream flow into which the air and water mixture is ejected from the nozzle, c) a nozzle on the downstream edge portion of the vane spaced radially from the housing axis and located directly in straight airstream flow from the fan and disposed at an angle to the housing axis to eject the air and water mixture at an angle into the straight airstream flow, d) a multi-passage mixing block exterior to the tubular housing defining a mixing chamber wherein pressurized air and water are mixed and then delivered through conduit means to the nozzles for ejection into the airstream, and e) respective pressure regulators for regulating the pressure of the water and air entering the mixing chamber.

4. In snowmaking apparatus wherein a tubular housing has opposite coaxial inlet and outlet ends with a fan mounted concentrically with respect to the housing remote from the housing outlet end for forcing an airstream through the housing and with water spray means adjacent the housing outlet end for spraying water into the airstream, a nucleator assembly including a multi-passage mixing block into which air and water enter each through its own inlet port and mix together for discharge of the mixture from at least one outlet port and then into the airstream upstream of the water spray means comprising a) straight holes converging into the block from the respective ports each with an inner end substantially of concave shape, b) the concave inner end of each hole intersecting with the concave inner ends of at least two of the other holes to form cross openings among the hole inner ends, c) whereby when fluids are introduced through the inlet ports they pass through said openings to be mixed together and then discharged from said at least one outlet port.

5. A multi-passage mixing block into which separate fluids enter each through its own inlet port and mix together for discharge of the mixture from at least one outlet port comprising a) straight holes converging into the block from the respective ports each with an inner end substantially of concave shape, b) the concave inner end of each hole intersecting with the concave inner ends of at least two of the other holes to form cross openings among the hole inner ends, c) whereby when fluids are introduced through the inlet ports they pass through said openings to be mixed together and then discharged from said at least one outlet port.

6. A mixing block according to claim 4 wherein two fluids enter the block through two respective inlet ports and after mixing are discharged through two respective outlet ports with two cross openings in the concave inner end of each hole.

7. A mixing block according to claim 4 wherein the holes are of equal diameter and each hole is at right angles to two other holes.

8. A mixing block according to claim 4 wherein the cross openings are all substantially of equal cross sectional area.

9. A multi-passage mixing block into which air and water enter through two respective inlet ports and mix together for discharge of the air-water mixture from two respective outlet ports comprising a) four straight holes of equal diameter converging into the block from the respective ports each with an inner end substantially of concave shape with each hole being at right angles to at least two other holes, b) the concave inner end of each hole intersecting with the concave inner ends of two of the other holes to form two cross openings in the inner end of each hole interconnecting the four hole inner ends, c) whereby when air and water are introduced through the inlet ports they pass through said openings to be mixed together and discharged from the outlet ports.

10. In snowmaking apparatus wherein a tubular housing has opposite coaxial inlet and outlet ends with a fan mounted concentrically with respect to the housing remote from the housing outlet end for forcing an airstream through the housing and with water spray means adjacent the housing outlet end for spraying water into the airstream, a nucleator assembly comprising a) a multi-passage mixing block into which air and water enter each through its own inlet port and are mixed together for discharge of the air-water mixture from at lest one outlet port, b) the mixing block being exterior to said tubular housing, and c) conduit means for directing the air-water mixture from said at least one outlet port into the airstream upstream of the water spray means.

11. In snowmaking apparatus wherein a tubular housing has opposite coaxial inlet and outlet means with a fan mounted concentrically with respect to the housing remote from the housing outlet end for forcing an airstream through the housing and with water spray means adjacent the housing outlet end for spraying water into the airstream, a nucleator assembly comprising a) a multi-passage mixing block into which air and water enter each through its own inlet port and are mixed together for discharge of the air-water mixture from at least one outlet port and then into the airstream upstream of the water spray means, b) conduit means for directing the air water mixture from said at least one outlet port into the airstream upstream of the water spray means, and c) respective pressure regulators for regulating the pressure of the air and water entering the mixing block.

* * * * *